US008082134B2

(12) United States Patent
Huang

(10) Patent No.: US 8,082,134 B2
(45) Date of Patent: Dec. 20, 2011

(54) TECHNIQUES FOR MODELING/SIMULATING, DESIGNING OPTIMIZING, AND DISPLAYING HYBRID DRILL BITS

(75) Inventor: Sujian Huang, Beijing (CN)

(73) Assignee: Smith International, Inc., Houston, TX (US)

( * ) Notice: Subject to any disclaimer, the term of this patent is extended or adjusted under 35 U.S.C. 154(b) by 1240 days.

(21) Appl. No.: 11/096,247

(22) Filed: Mar. 31, 2005

(65) Prior Publication Data

US 2005/0273301 A1 Dec. 8, 2005

Related U.S. Application Data

(63) Continuation-in-part of application No. 10/749,019, filed on Dec. 29, 2003, now abandoned, which is a continuation of application No. 09/524,088, filed on Mar. 13, 2000, now Pat. No. 6,516,293, application No. 11/096,247, which is a continuation-in-part of application No. 10/411,542, filed on Apr. 10, 2003, now abandoned, which is a continuation of application No. 09/635,116, filed on Aug. 9, 2000, now Pat. No. 6,873,947, which is a continuation of application No. 09/524,088, filed on Mar. 13, 2000, now Pat. No. 6,516,293, application No. 11/096,247, which is a continuation-in-part of application No. 10/888,523, filed on Jul. 9, 2004, now Pat. No. 7,844,426.

(51) Int. Cl.
*G06G 7/48* (2006.01)

(52) U.S. Cl. ..... 703/10

(58) Field of Classification Search ..... 703/10
See application file for complete search history.

(56) References Cited

U.S. PATENT DOCUMENTS 6,213,225 B1 * 4/2001 Chen ..... 175/57

FOREIGN PATENT DOCUMENTS

GB 2367843 4/2002

OTHER PUBLICATIONS

Cooper et al.; An interactive drilling simulator for teaching and research; pp. 1-12; 1995; Petroleum computer conference.*
Examination Report issued in corresponding British Application No. GB0912772.1; Dated Mar. 2, 2011 (1 page).

* cited by examiner

*Primary Examiner* — Hughs Jones
(74) *Attorney, Agent, or Firm* — Osha Liang LLP

(57) ABSTRACT

A hybrid drill bit is modeled, simulated, designed, optimized, and displayed. The hybrid drill is modeled based on input bit design parameters. The modeled hybrid drill bit is then simulated as drilling an earth formation, where at least a portion of the simulation may be graphically displayed so as to allow a user to adjust one or more parameters of the hybrid drill bit, drill string, and/or earth formation. Formation interactions between a fixed cutting element of the hybrid drill bit and the earth formation and between a roller cone cutting element of the hybrid drill bit and the earth formation are determined based on models developed using, for example, laboratory-based formation interaction tests. Simulation of the modeled hybrid drill bit may be selectively repeated so as to allow a user to adjust one or more design parameters of the hybrid drill bit to affect a simulated drilling characteristic. Such designing of the hybrid drill bit may be performed until one or more bit design parameters are accepted as being optimized.

18 Claims, 12 Drawing Sheets

TECHNIQUES FOR MODELING/SIMULATING, DESIGNING OPTIMIZING, AND DISPLAYING HYBRID DRILL BITS

CROSS-REFERENCE TO RELATED APPLICATIONS

This application is a continuation-in-part of U.S. patent application Ser. Nos. 10/749,019, filed Dec. 29, 2003 now abandoned, Ser. No. 10/411,542, filed Apr. 10, 2003 now abandoned, and Ser. No. 10/888,523, filed Jul. 9, 2004 now U.S. Pat. No. 7,844,426, the entirety of each of which is hereby incorporated by reference. U.S. patent application Ser. No. 10/749,019 is a continuation of U.S. patent application Ser. No. 09/524,088, filed Mar. 13, 2000 now U.S. Pat. No. 6,516,293, the entirety of which is hereby incorporated by reference. U.S. patent application Ser. No. 10/411,542 is a continuation of U.S. patent application Ser. No. 09/635,116, filed Aug. 9, 2000 now U.S. Pat. No. 6,873,947, the entirety of which is hereby incorporated by reference. U.S. patent application Ser. No. 09/635,116 is a continuation of U.S. patent application Ser. No. 09/524,088, the entirety of which is hereby incorporated by reference.

BACKGROUND

1. Field of the Invention

The present invention relates generally to hybrid drill bits that are used to drill boreholes in subterranean earth formations. More specifically, the present invention relates to techniques for modeling hybrid drill bits, simulating operation of hybrid drill bits, designing hybrid drill bits, optimizing drilling performance of hybrid drill bits, and displaying hybrid drill bits.

2. Background Art

Drill bits are commonly used in the oil and gas industry to drill boreholes (also referred to as "well bores") in subterranean earth formations. One example of a conventional drilling system for drilling boreholes in subterranean earth formations is shown in FIG. 1. The drilling system includes a drilling rig 10 that is used to rotate a drill string 12 that extends downward into a borehole 14. Connected to the distal end of the drill string 12 is a drill bit 20.

Two common types of drill bits used for drilling boreholes are known and referred to in the art as "fixed-cutter" drill bits and "roller cone" drill bits. A fixed-cutter drill bit 21, as shown in FIG. 2, typically includes a bit body 22 having (i) an externally threaded connection at one end 24 and (ii) a plurality of blades 26 extending from the other end of the bit body 22. The plurality of blades 26 form the cutting surface of the drill bit 21. A plurality of cutting elements 28 are attached to each of the blades 26 and extend from the blades 26. The plurality of cutting elements 28 are used to cut through subterranean earth formations when the drill bit 21 is rotated during drilling. The plurality of cutting elements 28 may be one or a combination of polycrystalline diamond compacts or other cutting elements formed of materials hard and strong enough to deform and/or cut through subterranean earth formations.

A roller cone drill bit 30, as shown in FIG. 3, typically includes a bit body 32 having (i) an externally threaded connection at one end 34 and (ii) a plurality of roller cones 36 (usually three as shown) attached to the other end of the drill bit 30. The plurality of roller cones 36 are able to rotate with respect to the bit body 32. Attached to the plurality of roller cones 36 are a plurality of cutting elements 38 typically arranged in rows about the surface of each of the plurality of roller cones 36. The plurality of cutting elements 38 may be one or a combination of tungsten carbide inserts, milled steel teeth, or other cutting elements formed of materials hard and strong enough to deform and/or cut through subterranean earth formations. Further, hardfacing (not shown) may be applied to the plurality of cutting elements 38 and/or other portions of the drill bit 30 to reduce wear on the drill bit 30 and/or to increase the useful life of the drill bit 30.

Another type of drill bit that may be used to drill boreholes in subterranean earth formations is known and referred to in the art as a "hybrid" drill bit. Hybrid drill bits include a combination of one or more fixed cutting elements (e.g., 28 in FIG. 2) and one or more roller cones (e.g., 36 in FIG. 3). As shown in FIG. 4, a hybrid drill bit 10 typically includes a bit body 12 having an externally threaded connection at one end 14 and a rock cutting structure at an opposite end. A pair of opposing roller cone legs 16 support roller cones 18 and 19. Adjacent to the roller cones 18 and 19, in an opposing relationship, is a pair of fixed bit legs 26 and 29 extending from and welded to the bit body 12. Fixed bit legs 26 and 29 terminate in fixed bit faces 28 and 31. Hydraulic nozzles or openings are formed in each fixed bit face 28 and 31, each opening communicating with a central hydraulic chamber in the bit body (not shown). Several diamond insert cutter blanks 32 are strategically positioned in faces 28 and 31, the diamond cutting face 34 of the insert blanks being so oriented to most effectively remove the ridges between kerfs cut by the tungsten carbide inserts in the adjacent cones 44 and 45.

The insert blanks 32, for example, are fabricated from a tungsten carbide substrate with a diamond layer 34 sintered to a face of a substrate, the diamond layer being composed of a polycrystalline material.

The roller cone 18, journaled to leg 16 of bit body 12, has a plurality of chisel type tungsten carbide inserts 22 inserted in the cone. The inserts are equidistantly spaced in each row and the outermost row on the cone is the gage row 21. The chisel crown 36 of gage inserts 25 are oriented in this gage row in a radial direction substantially parallel with the journal axis of the cone. Referring to both cones 18 and 19, the "A", "B", "C" and "D" rows of inner inserts 22 have their chisel crowns oriented in a circumferential direction substantially normal to the journal axis. With this orientation, the chisel crests or crowns 23 tend to penetrate more deeply into the borehole bottom rather than scrape and gouge as would be the normal function of a chisel insert with its crest oriented in a radial direction, especially in an offset type of rock bit.

One example of a hybrid drill bit is disclosed in U.S. Pat. No. 4,343,371 issued to Baker, III et al., which is assigned to the assignee of the present invention.

Significant resources (e.g., time, money) are needed in the design and manufacture of drill bits for use in drilling boreholes. Having accurate models for predicting and analyzing drilling characteristic of drill bits may greatly reduce costs associated with manufacturing drill bits and designing drilling operations because these models may be used to more accurately predict the performance of drill bits prior to their manufacture and/or use for a particular drilling application.

Modeling and simulation techniques for fixed-cutter bits are disclosed in: Sandia Report No. SAN86-1745 by David A. Glowka, printed in September 1987 and entitled "Development of a Method for Predicting the Performance and Wear of PDC Drill Bits"; U.S. Pat. Nos. 4,815,342, 5,010,789, 5,042,596, and 5,131,478; and U.S. patent application Ser. No. 10/888,358. Modeling and simulation techniques for roller cone drill bits are disclosed in: "The Computer Simulation of the Interaction Between Roller Bit and Rock" by D. Ma et al., printed in 1995 as paper no. 29922 in the *Society of Petroleum Engineers*; and U.S. Pat. No. 6,516,293, which is assigned to the assignee of the present invention.

SUMMARY

According to one aspect of one or more embodiments of the present invention, a method for designing a hybrid drill bit comprises: simulating the hybrid drill bit drilling in an earth formation; adjusting a value of at least one design parameter for the hybrid drill bit based on the simulating; and repeating the simulating and adjusting to change a simulated performance of the hybrid drill bit.

According to another aspect of one or more embodiments of the present invention, a method of designing a hybrid drill bit comprises: determining a performance characteristic of the hybrid drill bit; and graphically displaying the performance characteristic as at least one design parameter for the hybrid drill bit is adjusted.

According to another aspect of one or more embodiments of the present invention, a method for simulating a hybrid drill bit comprises: generating a model comprising data relating to at least one of interactions between a selected fixed cutting element and a selected earth formation and interactions between a selected roller cone cutting element and a selected earth formation; modeling the hybrid drill bit based on at least one input bit design parameter; and simulating the hybrid drill bit drilling an earth formation based on the model and the at least one input bit design parameter.

According to another aspect of one or more embodiments of the present invention, a method of designing a hybrid drill bit comprises: inputting a plurality of parameters relating to characteristics of the hybrid drill bit; and graphically displaying a model of the hybrid drill bit based on the plurality of parameters, where a displayed property of the model is changeable by changing at least one of the plurality of parameters.

Other aspects of the present invention will be apparent from the following description and the appended claims.

DETAILED DESCRIPTION

Generally, embodiments of the present invention relate to techniques for modeling/simulating, designing, optimizing, and displaying hybrid drill bits. In the following description of embodiments of the present invention, a "hybrid" drill bit is a drill bit that includes both at least one fixed surface having one or more cutting elements disposed thereon/therewith and at least one roller cone surface having one or more cutting elements disposed thereon/therein. Cutting elements disposed on/with a fixed surface of a hybrid drill bit are herein referred to as "fixed cutting elements." Cutting elements disposed on/with a roller cone surface of a hybrid drill bit are herein referred to as "roller cone cutting elements." References herein to "cutting elements" in general include both fixed cutting elements and roller cone cutting elements.

Figure 1:
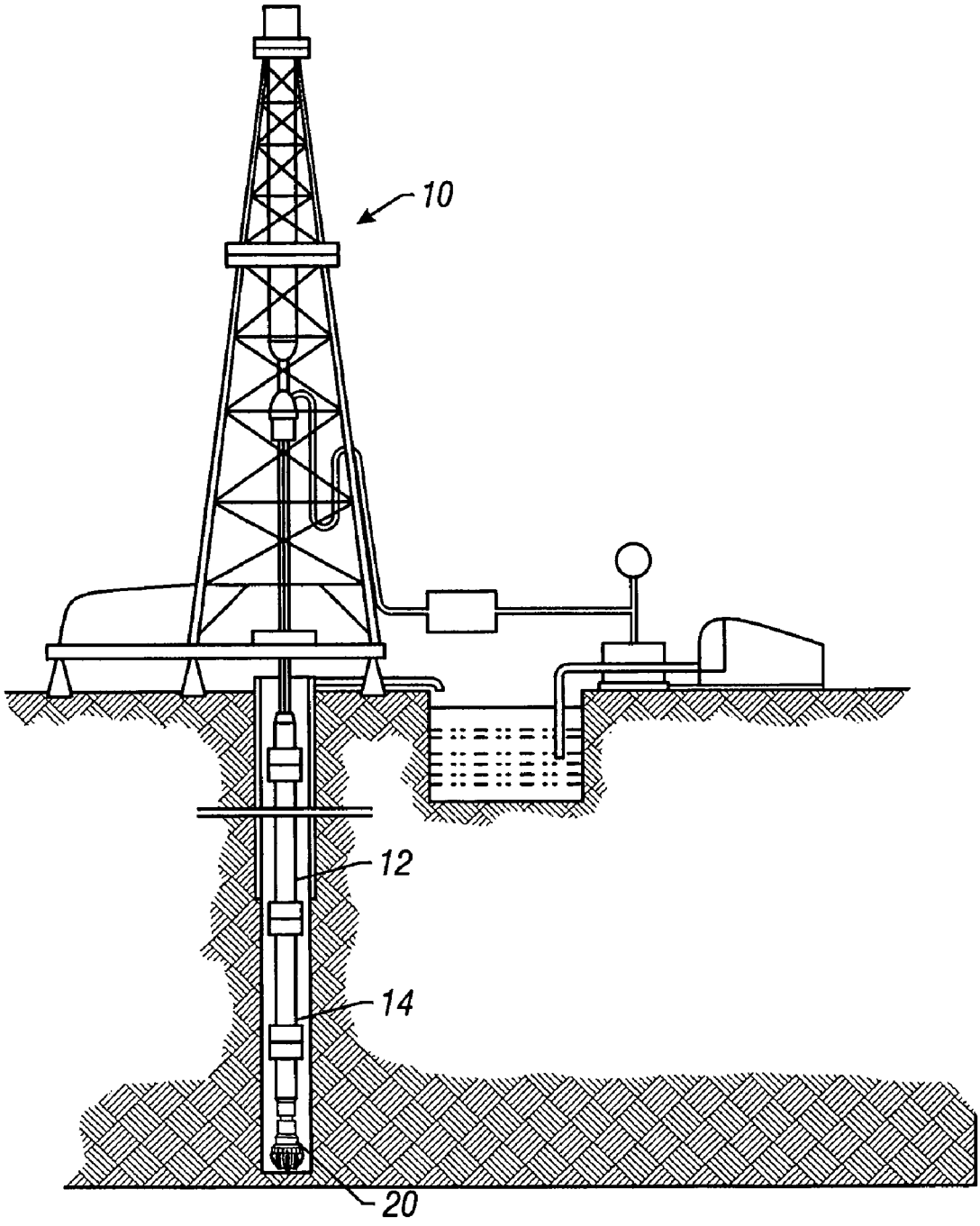
FIG.1 (Prior Art)
FIG. 1 shows a conventional drilling system.
Figure 2:
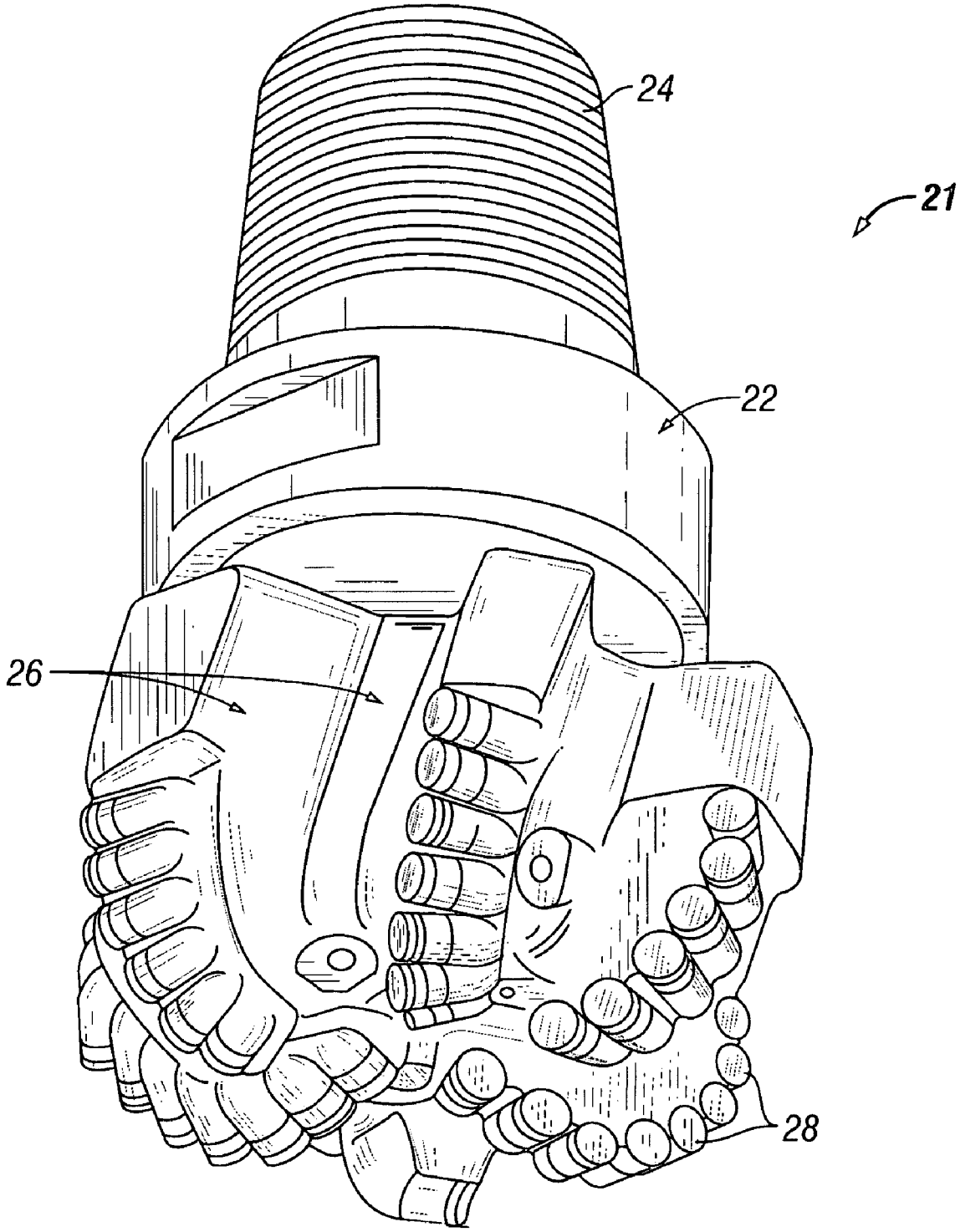
FIG. 2 (Prior Art)
FIG. 2 shows a fixed-cutter drill bit.
Figure 3:
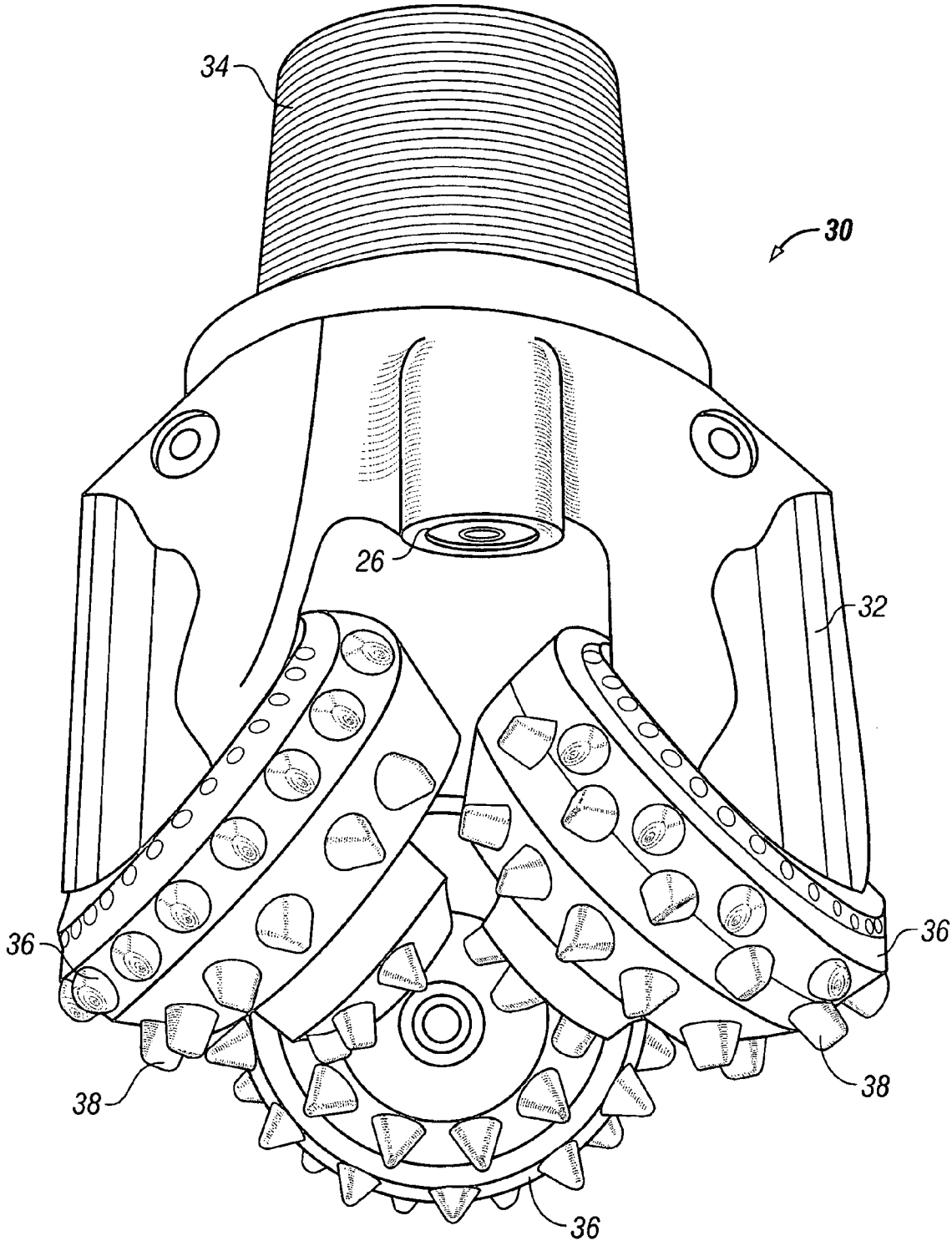
FIG. 3 (Prior Art)
FIG. 3 shows a roller cone drill bit.
Figure 4:
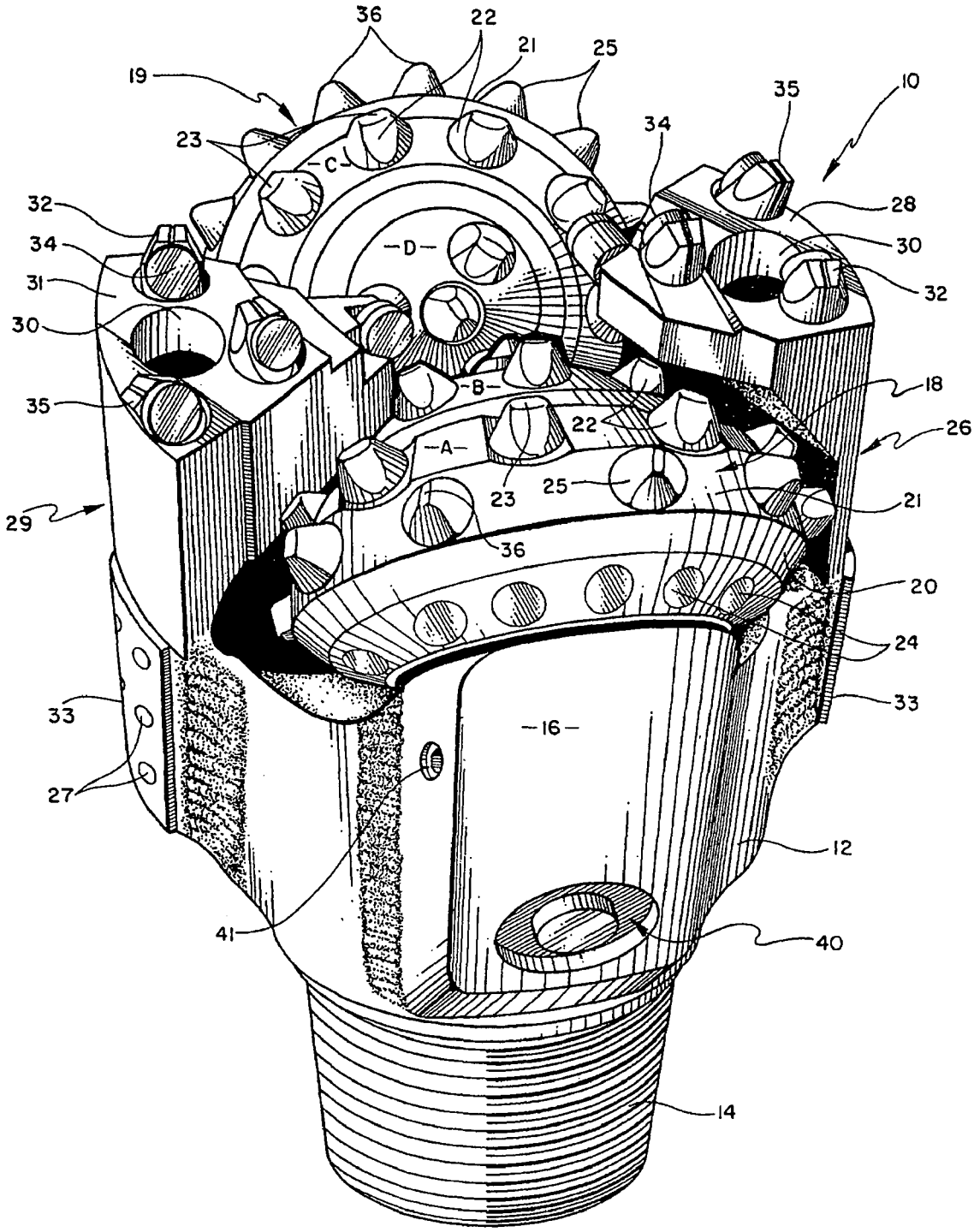
FIG. 4 shows a hybrid drill bit.
Figure 5:
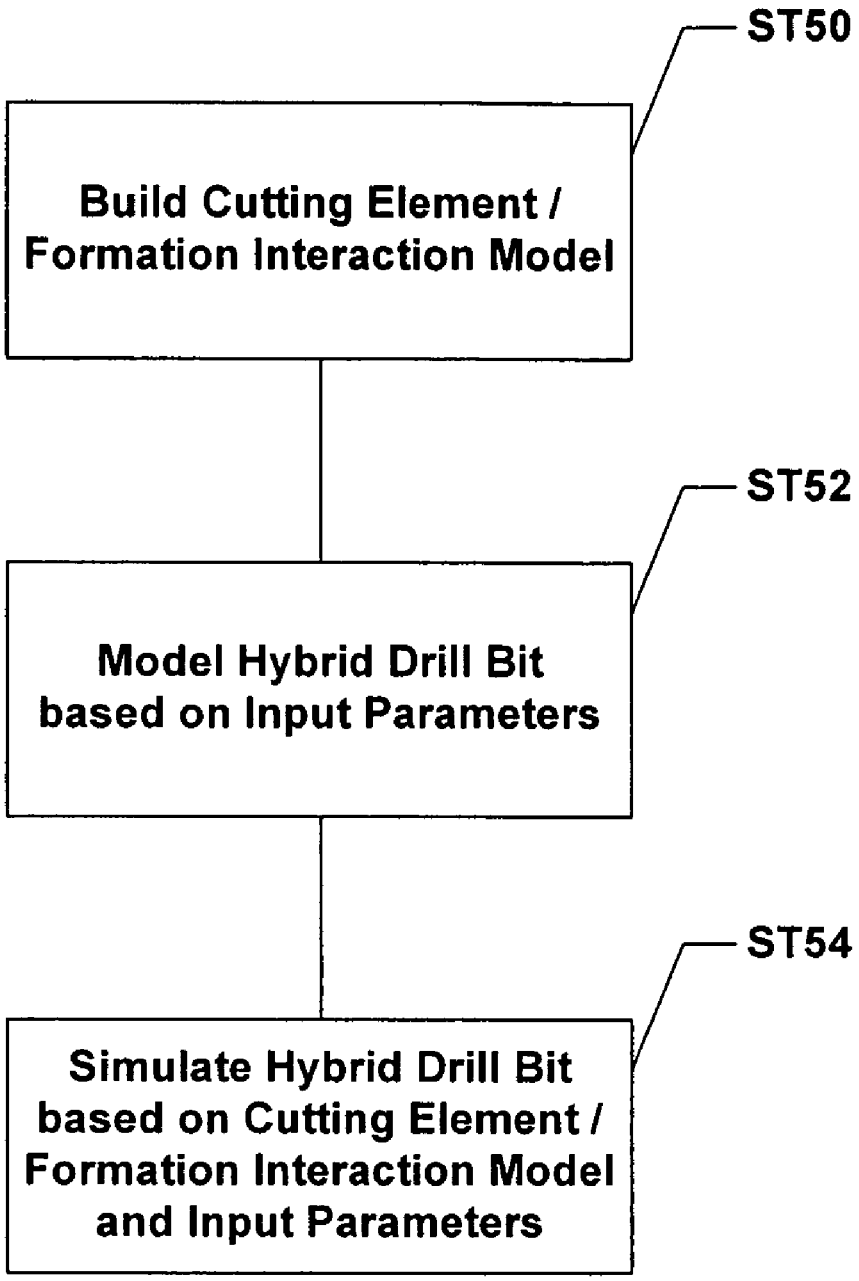
FIG. 5 shows a flow process in accordance with an embodiment of the present invention.

FIG. 5 shows an exemplary flow process in accordance with an embodiment of the present invention. The simulation and subsequent design and optimization of a hybrid drill bit may depend on data characterizing the interactions between (i) fixed cutting elements and an earth formation and (ii) roller cone cutting elements and an earth formation. Determining such data results in building a cutting element/formation interaction model ST50. Modeling the hybrid drill bit is based on input parameters (e.g., number of blades, number of roller cones) provided to a simulation tool ST52. The modeled hybrid drill bit, which may be graphically displayed in one or more embodiments of the present invention, is then simulated based on, for example, the cutting element/formation interaction model and the provided input parameters ST54.

U.S. patent application Ser. No. 10/888,358, the assignee of which is the assignee of the present invention and the entirety of which is hereby incorporated by reference, discloses techniques for building a formation interaction model for fixed cutting elements. U.S. Pat. No. 6,516,293, the assignee of which is the assignee of the present invention and the entirety of which is hereby incorporated by reference, discloses techniques for building a formation interaction model for roller cone cutting elements. In one or more embodiments of the present invention, techniques for building formation interaction models in U.S. patent application Ser. No. 10/888,358 and U.S. Pat. No. 6,516,293 may be used in any combination to build a formation interaction model for the fixed cutting elements and roller cone cutting elements of a hybrid drill bit.

In other embodiments, mathematical techniques, such as finite element analysis, may be used in conjunction with or in lieu of, the interaction model. Also, it should be noted that in building and using the model, techniques such as linear interpolation may be used. Further discussion of these points is found in U.S. Pat. No. 6,516,293 and U.S. patent application Ser. No. 10/888,358.

As discussed in U.S. Pat. No. 6,516,293, the parameters required as input for the simulation include drilling parameters, bit design parameters, cutting element/earth formation interaction data, and bottomhole geometry data. Typically the bottomhole geometry prior to any drilling simulation will be a planar surface, but this is not a limitation on the invention. The input data may be stored in an input library and later retrieved as need during simulation calculations.

Drilling parameters which may be used include the axial force applied on the drill bit, commonly referred to as the weight on bit (WOB), and the rotation speed of the drill bit, typically provided in revolutions per minute (RPM). It must be understood that drilling parameters are not limited to these variables, but may include other variables, such as, for example, rotary torque and mud flow volume. Additionally, drilling parameters provided as input may include the total number of bit revolutions to be simulated. However, it should be understood that the total number of revolutions is provided simply as an end condition to signal the stopping point of simulation, and is not necessary for the calculations required to simulate or visually represent drilling. Alternatively, another end condition may be employed to determine the termination point of simulation, such as the total drilling depth (axial span) to be simulated or any other final simulation condition. Alternatively, the termination of simulation may be accomplished by operator command, or by performing any other specified operation.

Bit design parameters used as input include bit cutting structure information, such as the cutting element location and orientation on the roller cones, and cutting element information, such as cutting element size(s) and shape(s). Bit design parameters may also include bit diameter, cone diameter profile, cone axis offset (from perpendicular with the bit axis of rotation), cutting element count, cutting element height, and cutting element spacing between individual cutting elements. The cutting element and roller cone geometry can be converted to coordinates and used as input for the invention. Preferred methods for bit design parameter inputs include the use of 3-dimensional CAD solid or surface models to facilitate geometric input.

Cutting element/earth formation interaction data used as input includes data which characterize the interaction between a selected earth formation (which may have, but need not necessarily have, known mechanical properties) and an individual cutting element having known geometry. Preferably, the cutting element/earth formation interaction data takes into account the relationship between cutting element depth of contact into the formation (interference depth) and resulting earth formation deformation. The deformation includes plastic deformation and brittle failure (fracture). Interaction data can be obtained through experimental testing and/or numerical modeling.

Bottomhole geometry data used as input includes geometrical information regarding the bottomhole surface of an earth formation, such as the bottomhole shape. As previously explained, the bottomhole geometry typically will be planar at the beginning of a simulation using the invention, but this is not a limitation on the invention. The bottomhole geometry can be represented as a set of axial (depth) coordinates positioned within a defined coordinate system, such as in a cartesian coordinate system. In this embodiment, a visual representation of the bottomhole surface is generated using a coordinate mesh size of 1 millimeter, but the mesh size is not a limitation on the invention.

Once the input data are entered or otherwise made available, calculations in the main simulation loop can be carried out. To summarize the functions performed in the main simulation loop, drilling simulation is incrementally calculated by "rotating" the bit through an incremental angle, and then iteratively determining the vertical (axial) displacement of the bit corresponding to the incremental bit rotation. Once the vertical displacement is obtained, the lateral forces on the cutting elements are calculated and are used to determine the current rotation speed of the cones. Finally, the bottomhole geometry is updated by removing the deformed earth formation resulting from the incremental drilling calculated in the simulation loop. A more detailed description of the elements in the simulation loop is as follows.

The first element in the simulation loop, involves "rotating" the roller cone bit (numerically) by the selected incremental angle amount, $\Delta\theta_{bit,i}$. In this example embodiment, the selected incremental angle is 3 degrees. It should be understood that the incremental angle is a matter of convenience for the system designer and is not intended to limit the invention. The incremental rotation of the bit results in an incremental rotation of each cone on the bit, $\Delta\theta_{cone,i}$. To determine the incremental rotation of the cones, $\Delta\theta_{cone,i}$, resulting from the incremental rotation of the bit, $\Delta\theta_{bit,i}$, requires knowledge of the rotational speed of the cones. In one example, the rotational speed of the cones is determined by the rotational speed of the bit and the effective radius of the "drive row" of the cone. The effective radius is generally related to the radial extent of the cutting elements that extend axially the farthest from the axis of rotation of the cone, these cutting elements generally being located on a so-called "drive row". Thus the rotational speed of the cones can be defined or calculated based on the known bit rotational speed of the bit and the defined geometry of the cone provided as input (e.g., the cone diameter profile, and cone axial offset). Then the incremental rotation of the cones, $\Delta\theta_{cone,i}$, is calculated based on incremental rotation of the bit, $\Delta\theta_{bit,i}$, and the calculated rotational speed of the cones. Alternatively, the incremental rotation of the cones can be calculated according to the frictional force between the cutting elements and the formation using a method as described, for example, in D. Ma et al, *The Computer Simulation of the Interaction Between Roller Bit and Rock*, paper no. 29922, Society of Petroleum Engineers, Richardson, TX (1995).

Once the incremental angle of each cone $\Delta\theta_{cone,i}$ is calculated, the new locations of the cutting elements, $p_{\theta,i}$are computed based on bit rotation, cone rotation, and the immediately previous locations of the cutting elements $p_{i-1}$. The new locations of the cutting elements 326 can be determined by geometric calculations known in the art. Based on the new locations of the cutting elements, the vertical displacement of the bit resulting from the incremental rotation of the bit is, in this embodiment, iteratively computed in a vertical force equilibrium loop.

In the vertical force equilibrium loop, the bit is "moved" (axially) downward (numerically) a selected initial incremental distance $\Delta d_i$ and new cutting element locations $p_i$ are calculated. In this example, the selected initial incremental distance is 2 mm. It should be understood that the initial incremental distance selected is a matter of convenience for the system designer and is not intended to limit the invention. Then the cutting element interference with the existing bottomhole geometry is determined. This includes determining the depth of penetration of each cutting element into the earth formation, and a corresponding interference projection area.. The depth of penetration is defined as the distance from the formation surface a cutting element penetrates into an earth formation, which can range from zero (no penetration) to the full height of the cutting element (full penetration). The interference projection area is the fractional amount of surface area of the cutting element which actually contacts the earth formation. Upon first contact of a cutting element with the earth formation, such as when the formation presents a smooth, planar surface to the cutting element, the interference projection area is substantially equal to the total contact surface area corresponding to the depth of penetration of the cutting element into the formation. However, upon subsequent contact of cutting elements with the earth formation during simulated drilling, each cutting element may have subsequent contact over less than the total contact area. This less than full area contact comes about as a result of the formation surface having "craters" (deformation pockets) made by previous contact with a cutting element. Fractional area contact on any of the cutting elements reduces the axial force on those cutting elements, which can be accounted for in the simulation calculations.

Once the cutting element/earth formation interaction is determined for each cutting element, the vertical force, $f_{v,i}$ applied to each cutting element is calculated based on the calculated penetration depth, the projection area, and the cutting element/earth formation interaction data. Thus, the axial force acting on each cutting element is related to the cutting element penetration depth and the cutting element interference projection area. In this embodiment, a simplifying assumption used in the simulation is that the WOB is equal to the summation of vertical forces acting on each cutting element. Therefore the vertical forces, $f_{v,i}$, on the cutting elements are summed to obtain a total vertical force $F_{v,i}$ on the bit, which is then compared to the selected axial force applied to the bit (the WOB) for the simulation. If the total vertical force $F_{v,i}$ is greater than the WOB, the initial incremental distance $\Delta d_i$ applied to the bit is larger than the incremental axial distance that would result from the selected WOB. If this is the case, the bit is moved up a fractional incremental distance (or, expressed alternatively, the incremental axial movement of the bit is reduced), and the calculations in the vertical force equilibrium loop are repeated for the resulting incremental distance. If the total vertical force $F_{v,i}$ on the cutting elements, using the resulting incremental axial distance is then less than the WOB, the resulting incremental distance $\Delta d_i$ applied to the bit is smaller than the incremental axial distance that would result from the selected WOB. In this case, the bit is moved further down a second fractional incremental distance, and the calculations in the vertical force equilibrium loop are repeated for the second resulting incremental distance. The vertical force equilibrium loop calculations iteratively continue until an incremental axial displacement for the bit is obtained which results in a total vertical force on the cutting elements substantially equal to the selected WOB, within a selected error range.

Once the incremental displacement, $\Delta d_i$, of the bit is obtained, the lateral movement of the cutting elements is calculated based on the previous, $p_{i-1}$, and current, $p_i$ cutting element locations. Then the lateral force, $f_{L,i}$, acting on the cutting elements is calculated based on the lateral movement of the cutting elements and cutting element/earth formation interaction data. Then the cone rotation speed is calculated based on the forces on the cutting elements and the moment of inertia of the cones.

Finally, the bottomhole pattern is updated by calculating the interference between the previous bottomhole pattern and the cutting elements during the current incremental drilling step, and based on cutting element/earth formation interaction, "removing" the formation resulting from the incremental rotation of the selected bit with the selected WOB. In this example, the interference can be represented by a coordinate mesh or grid having 1 mm grid blocks.

This incremental simulation loop can then be repeated by applying a subsequent incremental rotation to the bit and repeating the calculations in the incremental simulation loop to obtain an updated bottomhole geometry. Using the total bit revolutions to be simulated as the termination command, for example, the incremental displacement of the bit and subsequent calculations of the simulation loop will be repeated until the selected total number of bit revolutions to be simulated is reached. Repeating the simulation loop as described above will result in simulating the performance of a roller cone drill bit drilling earth formations with continuous updates of the bottomhole pattern drilled, simulating the actual drilling of the bit in a selected earth formation. Upon completion of a selected number of operations of the simulation loops, results of the simulation can be programmed to provide output information for characterizing the performance of the selected drill bit during the simulated drilling. It should be understood that the simulation can be stopped using any other suitable termination indicator, such as a selected axial displacement.

Output information for the simulation may include forces acting on the individual cutting elements during drilling, scraping movement/distance of individual inserts on hole bottom and on the hole wall, forces acting on the individual cones during drilling, total forces acting on the bit during drilling, and the rate of penetration for the selected bit. This output information may be presented in the form of a visual representation, such as a visual representation of the hole being drilled in an earth formation where crater sections calculated as being removed during drilling are visually "removed" from the bottom surface of the hole. Alternatively, the visual representation may include graphs of any of the parameters provided as input, or any or all of the parameters calculated in order to generate the visual representation. Graphs of parameters, for example, may include a graphical display of the axial and/or lateral forces on the different cones, on rows of cutting elements on any or all of the cones, or on individual cutting elements on the drill bit during simulated drilling. The visual representation of drilling may be in the form of a graphic display of the bottomhole geometry presented on a computer screen. However, it should be understood that the invention is not limited to this type of display or any other particular type of display. The means used for visually displaying aspects of simulated drilling is a matter of convenience for the system designer, and is not intended to limit the invention.

Those skilled in the art will note that methods for modeling hybrid drill bits based on cutting element/formation interaction data derived from laboratory tests conducted using the same or similar cutting elements on the same or similar formations may advantageously enable the more accurate prediction of the drilling characteristics for proposed hybrid drill bit designs. These methods may also enable optimization of hybrid drill bit designs and drilling parameters, and the production of new hybrid drill bit designs that exhibit more desirable drilling characteristics and/or longevity.

In one or more embodiments of the present invention, modeling a hybrid drill bit involves a user interface by which a designer may input bit design parameters. Input bit design parameters may include: (i) cutting structure information such as, for example, fixed cutting element location and orientation and roller cone cutting element location and orientation; and (ii) cutting element information such as, for example, fixed cutting element size(s) and shape(s) and roller cone cutting element size(s) and shape(s). This information may be input using a CAD interface, for example.

Figure 6:
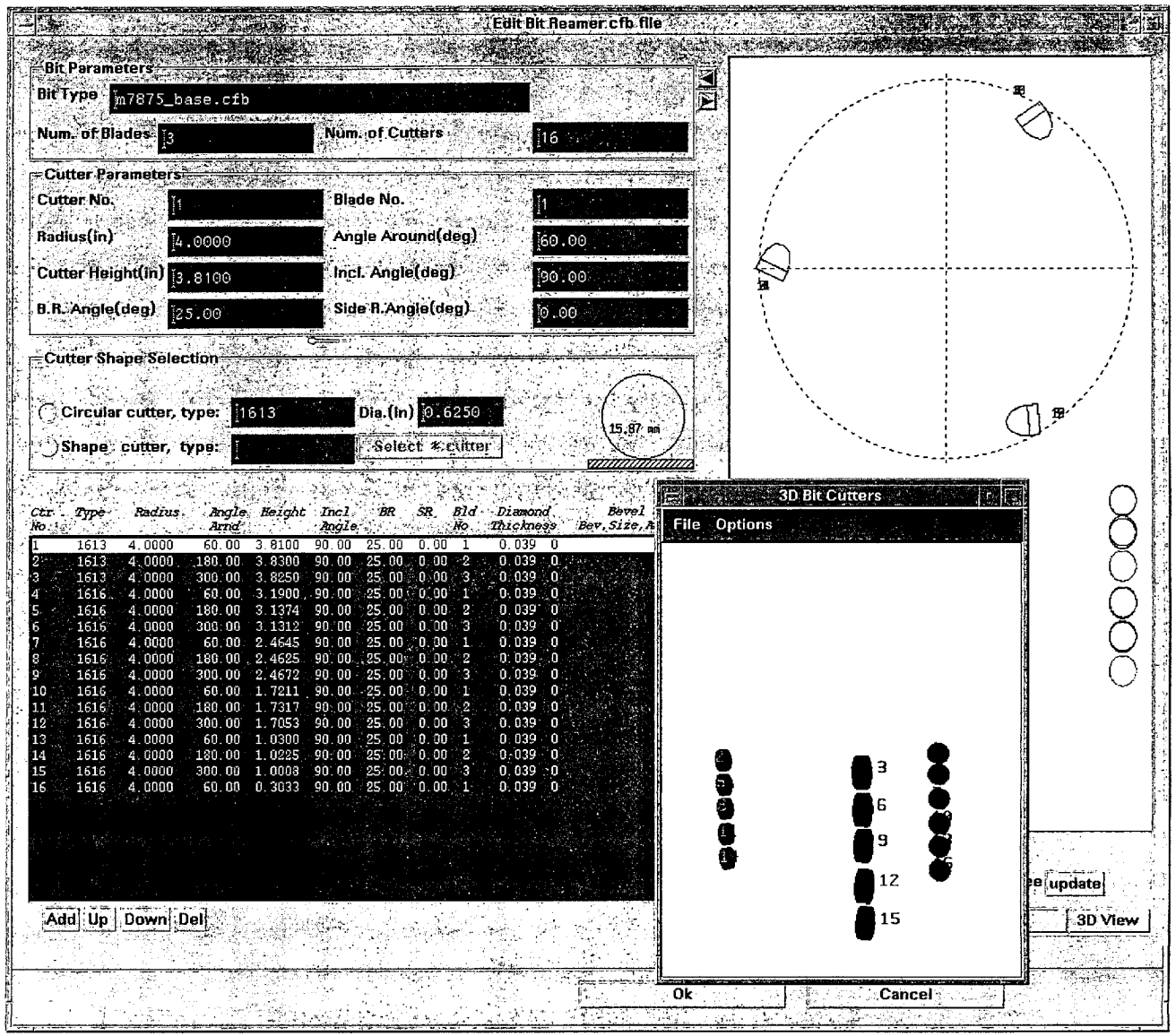
FIG. 6 shows a user interface for modeling a hybrid drill bit in accordance with an embodiment of the present invention.

FIG. 6 shows an exemplary user interface by which a designer may enter bit design parameters relating to the fixed cutting elements of a particular hybrid drill bit. In FIG. 6, the designer has modeled the hybrid drill bit as having three blades with a total of sixteen cutting elements. Further, as shown in FIG. 6, a designer may enter bit design parameters relating to, for example, a radius and a height of a particular fixed cutting element.

Figure 7:
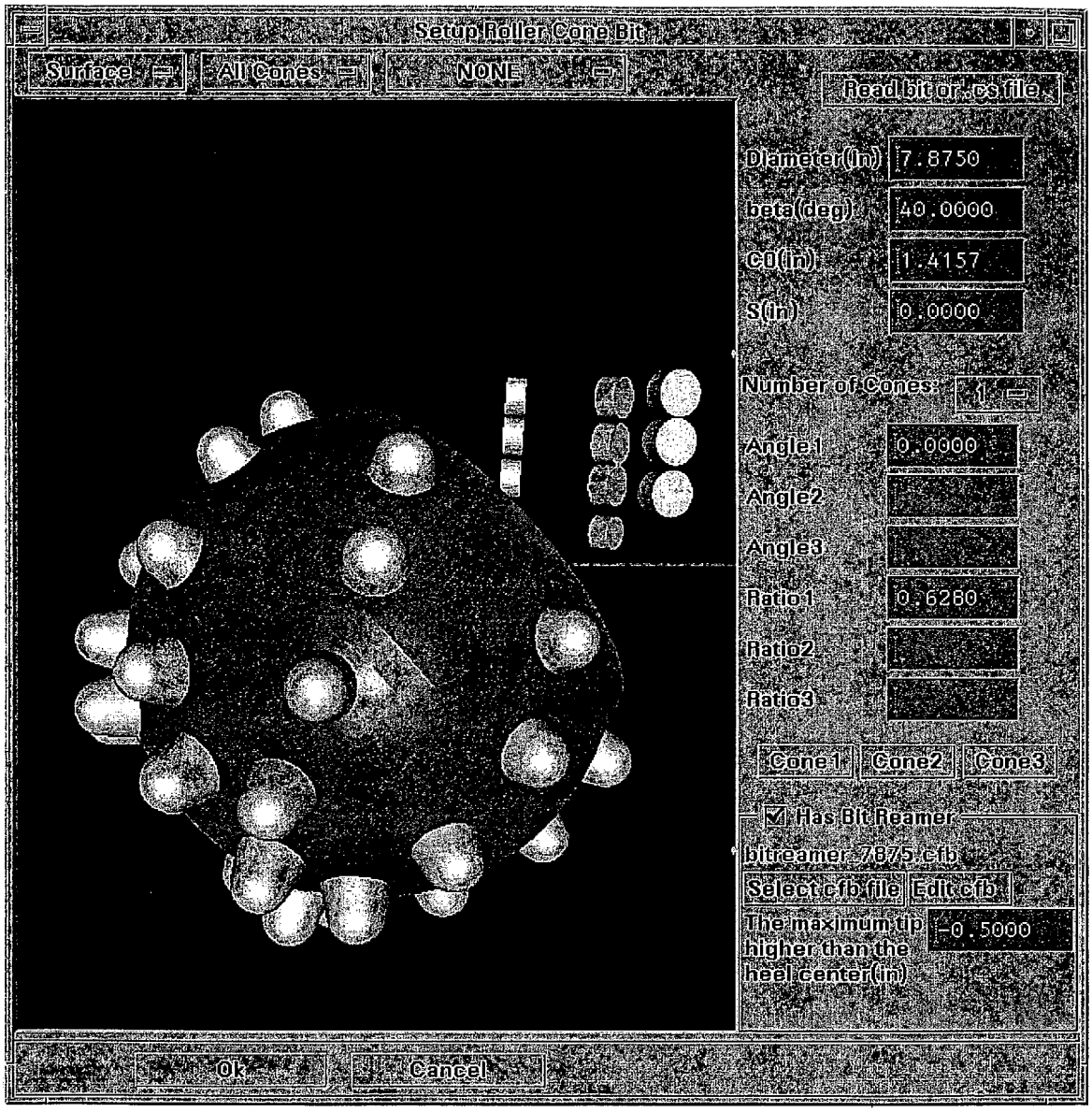
FIG. 7 shows a user interface for modeling a hybrid drill bit in accordance with an embodiment of the present invention.

FIG. 7 shows an exemplary user interface by which a designer may enter bit design parameters relating to roller cone cutting elements of a particular hybrid drill bit. In FIG. 7, the designer has modeled the hybrid drill bit as having a single roller cone. Further, as shown in FIG. 7, a designer may enter bit design parameters relating to, for example, a diameter and position of the single roller cone. Those skilled in the art will note that the hybrid drill bit model shown in FIG. 7 shows the relation of fixed cutting elements of the modeled hybrid drill bit to the single roller cone.

Figure 8:
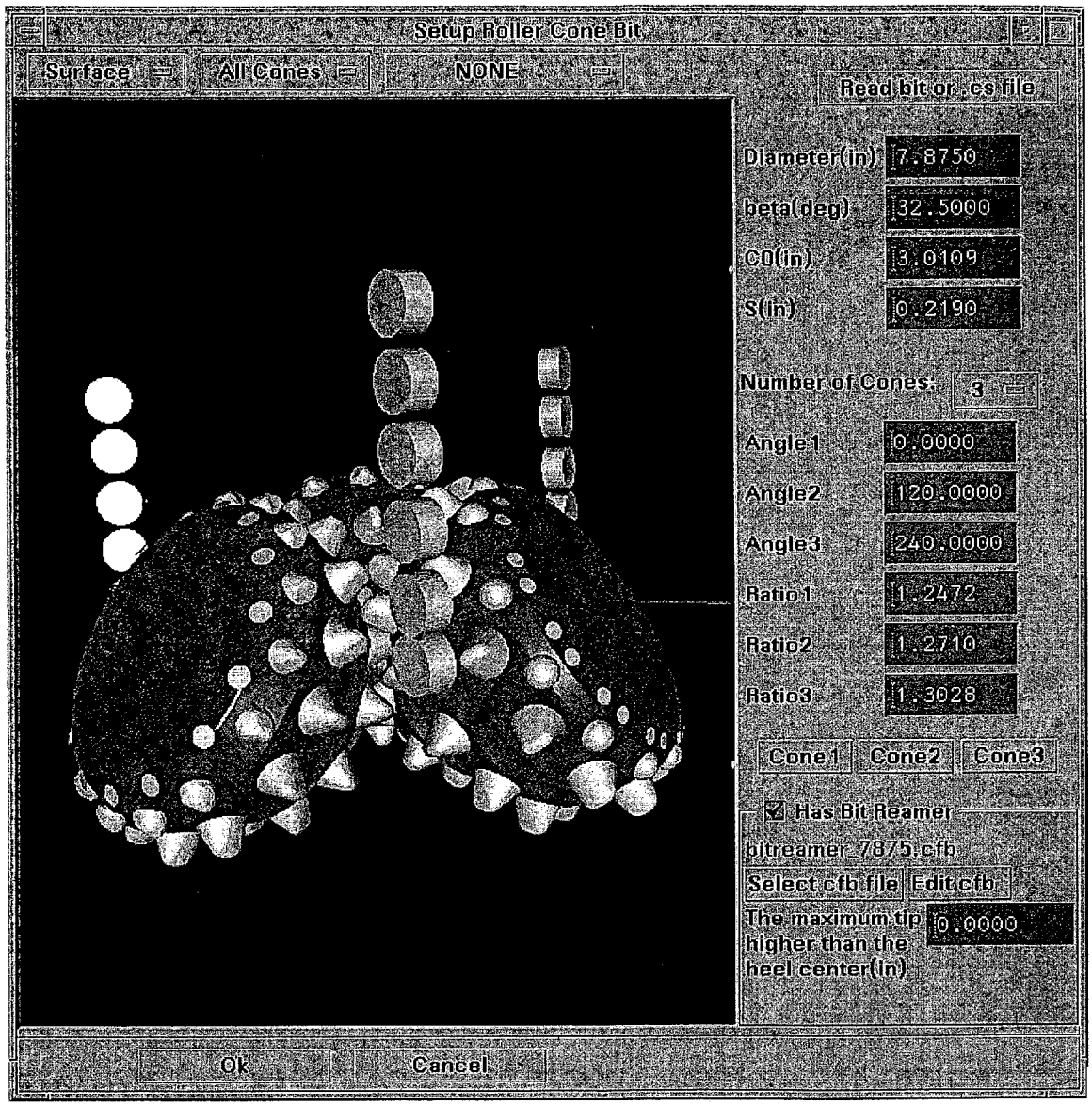
FIG. 8 shows a user interface for modeling a hybrid drill bit in accordance with an embodiment of the present invention.

FIG. 8 shows another exemplary user interface by which a designer may enter bit design parameters relating to roller cone cutting elements of a particular hybrid drill bit. In FIG. 8, the designer has modeled the hybrid drill bit as having three roller cones. Further, as shown in FIG. 8, a designer may enter bit design parameters relating to, for example, diameters and positions of the three roller cones. Those skilled in the art will note that the hybrid drill bit model shown in FIG. 8 shows the relation of fixed cutting elements of the modeled hybrid drill bit to the three roller cones.

Figure 9:
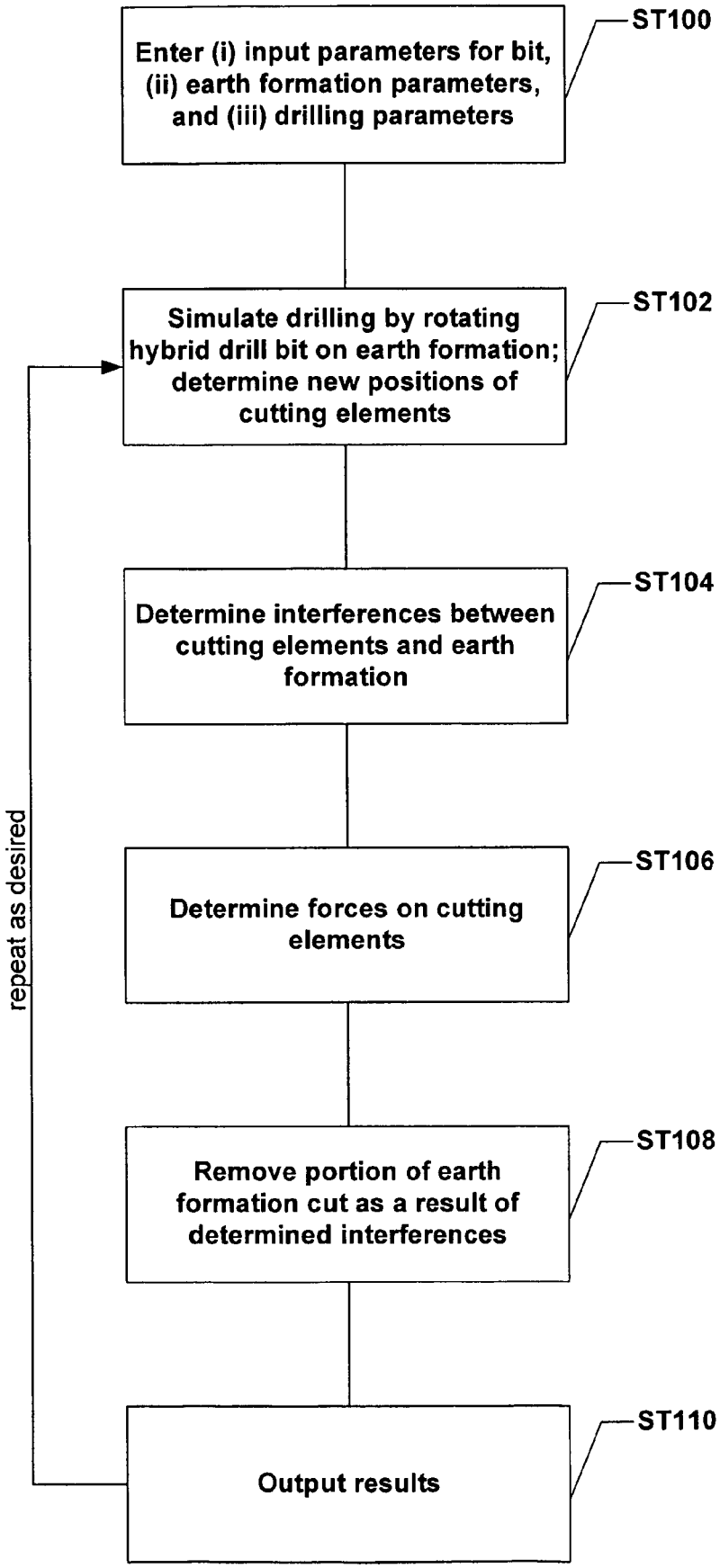
FIG. 9 shows a flow process in accordance with an embodiment of the present invention.

Upon generation of a model of a hybrid drill bit, a drilling operation of the modeled hybrid drill bit in an earth formation may then be simulated FIG. 9 shows an exemplary flow process for simulating a hybrid drill bit in accordance with an embodiment of the present invention. Simulation involves entering (i) input parameters for a hybrid drill bit, (ii) parameters of an earth formation to be drilled, and (iii) drilling operation parameters 100.

Input parameters for the hybrid drill bit may include, for example, a number of fixed surfaces having cutting elements disposed thereon, a number of cutting elements disposed on at least one of the number of fixed surfaces, a location of a cutting element disposed on at least one of the number of fixed surfaces, a type of cutting element disposed on at least one of the number of fixed surfaces, an orientation of a cutting element disposed on at least one of the number of fixed surfaces, a height of a cutting element disposed on at least one of the number of fixed surfaces, a radius of a cutting element disposed on at least one of the number of fixed surfaces, a diameter of a cutting element disposed on at least one of the number of fixed surfaces, a back rake angle of a cutting element disposed on at least one of the number of fixed surfaces, a side rake angle of a cutting element disposed on at least one of the number of fixed surfaces, a working surface shape of a cutting element disposed on at least one of the number of fixed surfaces, a bevel size of a cutting element disposed on at least one of the number of fixed surfaces, a bevel shape of a cutting element disposed on at least one of the number of fixed surfaces, a bevel orientation of a cutting element disposed on at least one of the number of fixed surfaces, a hardness of a cutting element disposed on at least one of the number of fixed surfaces, a shape of a cutting element disposed on at least one of the number of fixed surfaces, a number of roller cones having cutting elements disposed thereon, a number of cutting elements disposed on at least one of the number of roller cones, a location of a cutting element disposed on at least one of the number of roller cones, a type of cutting element disposed on at least one of the number of roller cones, an orientation of a cutting element disposed on at least one of the number of roller cones, a height of a cutting element disposed on at least one of the number of roller cones, a radius of a cutting element disposed on at least one of the number of roller cones, a diameter of a cutting element disposed on at least one of the number of roller cones, a working surface shape of a cutting element disposed on at least one of the number of roller cones, a hardness of a cutting element disposed on at least one of the number of roller cones, a spacing between cutting elements disposed on at least one of the number of roller cones, a shape of a cutting element disposed on at least one of the number of roller cones, an axis offset of at least one of the number of roller cones, a diameter of at least one of the number of roller cones, and a diameter of the hybrid drill bit.

Earth formation parameters may include, for example, a type of the earth formation, a mechanical strength of the earth formation, a density of the earth formation, a wear characteristic of the earth formation, a strength of the earth formation, an orientation of the earth formation, a diameter of a borehole, and a depth of a layer of the earth formation.

Drilling operation parameters may include, for example, a weight-on-bit, a bit torque, a rate of penetration, rotary speed of the hybrid drill bit, a mud type, a mud density, an angle of drilling, a load, and an axial force on the hybrid drill bit.

Referring still to FIG. 9, in one or more embodiments of the present invention, the simulation may involve: generating a numerical representation of the hybrid drill bit, generating a numeral representation of the earth formation, and simulating the hybrid drill bit drilling the earth formation by incrementally rotating the hybrid drill bit on the earth formation 102.

Upon an incremental rotation of the hybrid drill bit 102, new positions of fixed cutting elements and roller cone cutting elements of the hybrid drill bit are calculated. In one or more embodiments of the present invention, techniques for determining new positions of cutting elements upon an incremental rotation of a drill bit in U.S. patent application Ser. No. 10/888,358 and U.S. Pat. No. 6,516,293 may be used in any combination to determine positions of the fixed cutting elements and roller cone cutting elements of a hybrid drill bit.

Figure 10:
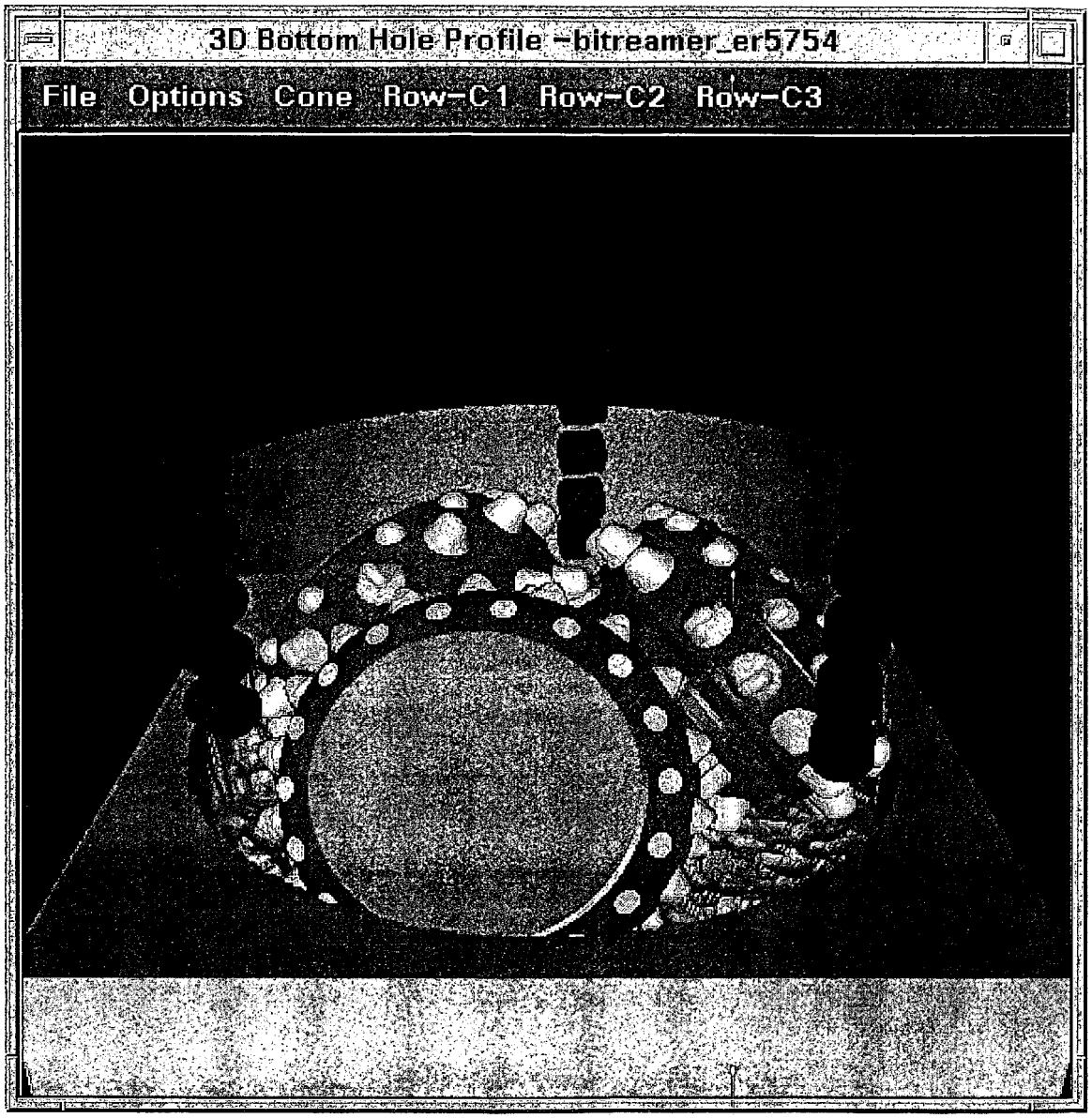
FIG. 10 shows a graphical display in accordance with an embodiment of the present invention.

The interference between the fixed cutting elements and the earth formation and between the roller cone cutting elements and the earth formation during the incremental rotation are determined 104. Such interference may be determined using a cutting element/formation interaction model such as described above. FIG. 10 shows an exemplary graphical display showing a simulation of a hybrid drill bit in engagement with an earth formation.

Those skilled in the art will note that with respect to the roller cone cutting elements, there is an added level of complexity in determining interference due the roller cone cutting elements being disposed on roller cones which themselves are rotating with respect to the rotation of the hybrid drill bit. Analyses of interference between cutting elements of a roller cone and an earth formation are detailed in U.S. Pat. No. 6,516,293.

Figure 11:
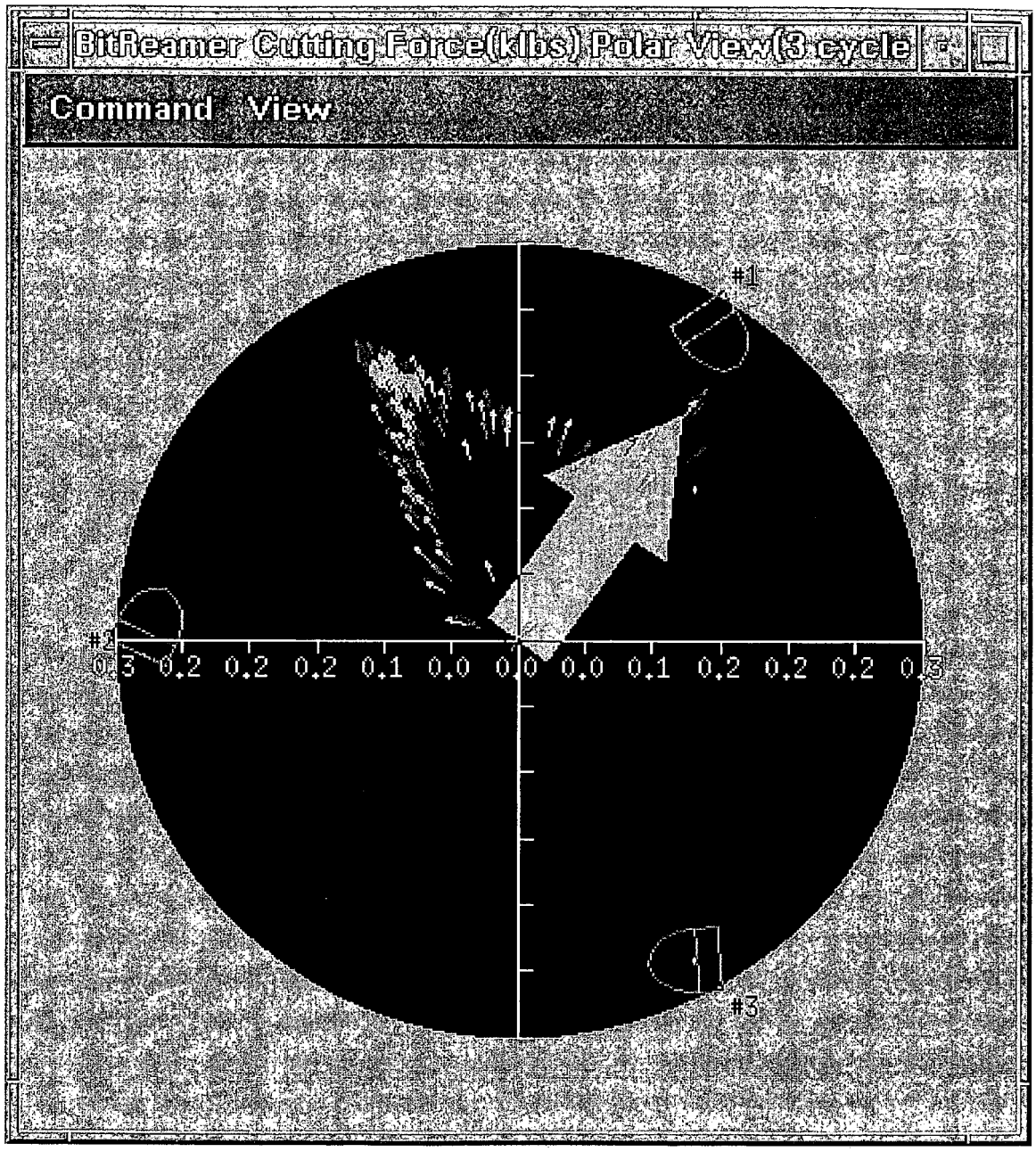
FIG. 11 shows a graphical display in accordance with an embodiment of the present invention.
Figure 12:
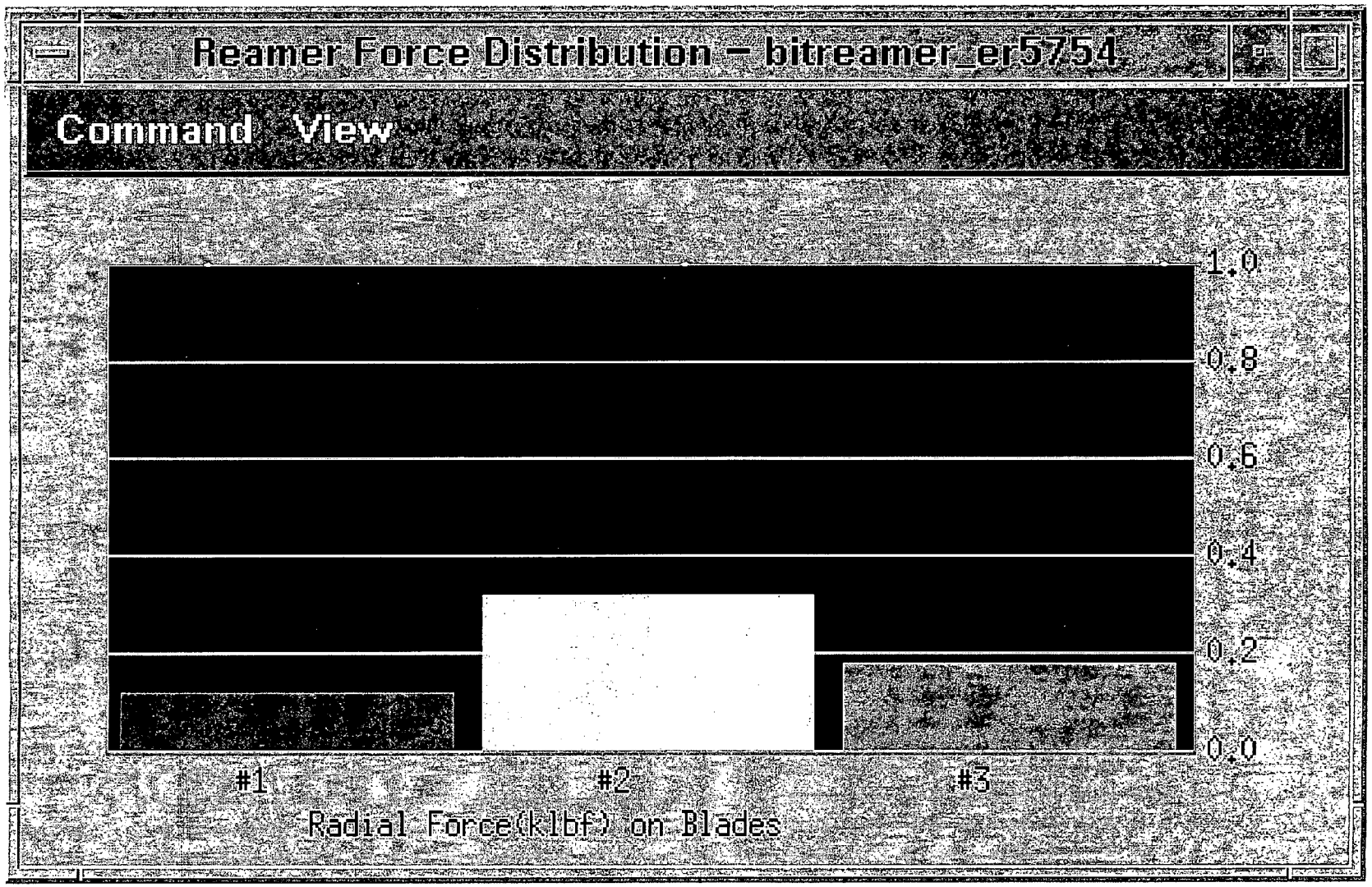
FIG. 12 shows a graphical display in accordance with an embodiment of the present invention.

In addition to determining interference between the fixed cutting elements and the earth formation and between the roller cone cutting elements and the earth formation, forces on the fixed cutting elements and the roller cone cutting elements resulting from the interference may be determined 106. FIG. 11 shows an exemplary graphical display showing determined cutting forces during simulation of a hybrid drill bit. Such determined force information may be used to determine which cutting elements are experiencing the most force. For example, FIG. 12 shows an exemplary distribution of radial forces on blades of a hybrid drill bit.

Finally, the bottomhole geometry is updated to remove the portion of the earth formation cut by the fixed cutting elements and the roller cone cutting elements as a result of the interference during the incremental rotation of the hybrid drill bit 108. The steps of incrementally rotating 102, determining interference 104, determining forces 106, and updating 108 may be repeated to simulate the hybrid drill bit drilling through the earth formation with results determined for each incremental rotation being provided as output 110 (e.g., via a graphical interface).

Those skilled in the art will note that while FIG. 9 shows a general flow process for simulating a hybrid drill bit in accordance with an embodiment of the present invention, U.S. patent application Ser. No. 10/888,358 and U.S. Pat. No. 6,516,293, the entirety of both having been incorporated by reference, disclose detailed simulation techniques for fixed-cutter drill bits and roller cone drill bits, respectively, that may be applied, at least in part, to the simulation of a hybrid drill bit in accordance with one or more embodiments of the present invention.

Based on simulation of a hybrid drill bit as described above, a designer may design a hybrid drill bit by selectively changing/adjusting certain parameters to effectuate certain performance characteristics and/or drilling behavior. For example, a method in accordance with one or more embodiments of the present invention includes selecting bit design parameters, drilling parameters, and an earth formation to be represented as drilled. Then, a hybrid drill bit having the selected bit design parameters is simulated as drilling in the selected earth formation under the conditions dictated by the selected drilling parameters. The simulating includes calculating the interaction between the cutting elements on the hybrid drill bit and the earth formation at selected increments during drilling. This includes calculating parameters for the cuts made in the formation by each of the cutting elements on the hybrid drill bit and determining the forces and the wear on each of the cutting elements during drilling. Then, depending upon the calculated performance of the hybrid drill bit during the drilling of the earth formation, at least one of the bit design parameters is adjusted. The simulating is then repeated for the adjusted bit design. The adjusting of the at least one design parameter and the repeating of the simulating are repeated until a desired set of bit design parameters is obtained. Once a desired set of bit parameters is obtained, the desired set of bit parameters may be used for an actual hybrid drill bit design.

A set of bit design parameters may be determined to be a desired set when the drilling performance determined for the hybrid drill bit is selected as acceptable. In one embodiment of the present invention, the drilling performance may be determined to be acceptable when the calculated imbalance force on the hybrid drill bit during drilling is less than or equal to a selected amount.

In another aspect of one or more embodiments of the invention, a method for optimizing drilling parameters of a hybrid drill bit is provided. Such an exemplary method involves selecting initial drilling parameters and selecting earth formation(s) to be represented as drilled. The method also includes simulating the hybrid drill bit having the selected bit design drilling the selected earth formation(s) under drilling conditions dictated by the selected drilling parameters. The simulating may involve calculating interaction between cutting elements on the selected hybrid drill bit and the earth formation at selected increments during drilling and determining the forces on the cutting elements based on cutting element/formation interaction data in accordance with the description above. The method further includes adjusting at least one drilling parameter and repeating the simulating (including drilling calculations) until an optimal set of drilling parameters is obtained. An optimal set of drilling parameters may be any set of drilling parameters that result in an improved drilling performance over previously proposed drilling parameters. In one or more embodiments of the present invention, drilling parameters are determined to be optimal when the drilling performance of the bit (e.g., calculated rate of penetration) is determined to be maximized for a given set of drilling constraints (e.g., within acceptable WOB or ROP limitations for the system).

Methods in accordance with the above aspect may be used to analyze relationships between drilling parameters and drilling performance for a given hybrid drill bit design. This method may also be used to optimize the drilling performance of a selected hybrid drill bit design.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed is:

1. A computer implemented method of designing a hybrid drill bit, comprising:

simulating the hybrid drill bit drilling in an earth formation, wherein the simulating comprises:

incrementally rotating the hybrid drill bit;

determining a position of at least one fixed cutting element of the hybrid drill bit after the incremental rotation;

determining a position of at least one roller cone cutting element of the hybrid drill bit after the incremental rotation;

determining a portion of the earth formation cut by the at least one fixed cutting element and the roller cone cutting element; and removing the cut portion from the simulating;

adjusting a value of at least one design parameter for the hybrid drill bit based on the simulating;

repeating the simulating and adjusting to change a simulated performance of the hybrid drill bit, until a desired set of bit design parameters is obtained; and outputting an optimized hybrid drill bit design based on the simulating, adjusting, and repeating.

2. The method of claim 1, further comprising:

graphically displaying at least a portion of the simulating; and adjusting the value of the at least one design parameter in response to the graphically displaying; and repeating the simulating, graphically displaying, and adjusting to change the simulated performance of the hybrid drill bit.

3. The method of claim 1, further comprising:

repeating the simulating and adjusting to optimize a performance characteristic.

4. The method of claim 1, the simulating comprising:

simulating at least one performance characteristic at a plurality of increments of the simulated hybrid drill bit rotation.

5. The method of claim 1, wherein the bit design parameter consists of at least one selected from a group of a number of fixed surfaces having cutting elements disposed thereon, a number of cutting elements disposed on at least one of the number of fixed surfaces, a location of a cutting element disposed on at least one of the number of fixed surfaces, a type of cutting element disposed on at least one of the number of fixed surfaces, an orientation of a cutting element disposed on at least one of the number of fixed surfaces, a height of a cutting element disposed on at least one of the number of fixed surfaces, a radius of a cutting element disposed on at least one of the number of fixed surfaces, a diameter of a cutting element disposed on at least one of the number of fixed surfaces, a back rake angle of a cutting element disposed on at least one of the number of fixed surfaces, a side rake angle of a cutting element disposed on at least one of the number of fixed surfaces, a working surface shape of a cutting element disposed on at least one of the number of fixed surfaces, a bevel size of a cutting element disposed on at least one of the number of fixed surfaces, a bevel shape of a cutting element disposed on at least one of the number of fixed surfaces, a bevel orientation of a cutting element disposed on at least one of the number of fixed surfaces, a hardness of a cutting element disposed on at least one of the number of fixed surfaces, a shape of a cutting element disposed on at least one of the number of fixed surfaces, a number of roller cones having cutting elements disposed thereon, a number of cutting elements disposed on at least one of the number of roller cones, a location of a cutting element disposed on at least one of the number of roller cones, a type of cutting element disposed on at least one of the number of roller cones, an orientation of a cutting element disposed on at least one of the number of roller cones, a height of a cutting element disposed on at least one of the number of roller cones, a radius of a cutting element disposed on at least one of the number of roller cones, a diameter of a cutting element disposed on at least one of the number of roller cones, a working surface shape of a cutting element disposed on at least one of the number of roller cones, a hardness of a cutting element disposed on at least one of the number of roller cones, a spacing between cutting elements disposed on at least one of the number of roller cones, a shape of a cutting element disposed on at least one of the number of roller cones, an axis offset of at least one of the number of roller cones, a diameter of at least one of the number of roller cones, and a diameter of the hybrid drill bit.

6. The method of claim 1, the earth formation parameter comprising at least one selected from the group consisting of a type of the earth formation, a mechanical strength of the earth formation, a density of the earth formation, a wear characteristic of the earth formation, a strength of the earth formation, an orientation of the earth formation, a diameter of a borehole, and a depth of a layer of the earth formation.

7. The method of claim 1, the drilling operation parameter comprising at least one selected from the group consisting of a weight-on-bit, a bit torque, a rate of penetration, rotary speed of the hybrid drill bit, a mud type, a mud density, an angle of drilling, a load, and an axial force on the hybrid drill bit.

8. The method of claim 1, the simulating further comprising:

selectively repeating the incrementally rotating, the determining the position of the at least one fixed cutting element, the determining the position of the at the least one roller cone cutting element, the determining a portion of the earth formation cut, and the removing.

9. The method of claim 1, wherein at least one of the additional plurality of parameters relates to a property of the earth formation.

10. The method of claim 1, the simulating comprising:

calculating forces on at least one of a fixed cutting element of the hybrid drill bit and a roller cone cutting element of the hybrid drill bit.

11. The method of claim 1, wherein the simulating is dependent on data obtained from a formation interaction test of the at least one fixed cutting element.

12. The method of claim 11, the formation interaction test comprising a fixed cutting element being impressed on an earth formation sample with a selected force having at least one of an axial component and a lateral component, said formation interaction test generating at least a correspondence between penetration depth of the fixed cutting element into the earth formation sample and the selected force.

13. The method of claim 1, further comprising:

determining a performance characteristic of the hybrid drill bit; and graphically displaying the performance characteristic as at least one design parameter for the hybrid drill bit is adjusted.

14. The method of claim 13, determining the performance characteristic comprising:

calculating the performance characteristic at a plurality of increments of rotation of the hybrid drill bit.

15. The method of claim 13, determining the performance characteristic comprising:

selecting at least one parameter affecting drilling performance from the group consisting of a bit design parameter, an earth formation parameter, and a drilling operation parameter.

16. The method of claim 1, further comprising:

inputting a plurality of parameters relating to characteristics of the hybrid drill bit; and graphically displaying a model of the hybrid drill bit based on the plurality of parameters, wherein a displayed property of the model is changeable by changing at least one of the plurality of parameters.

17. The method of claim 16, wherein the model is displayed in three dimensions.

18. The method of claim 16, further comprising:

inputting an additional plurality of parameters relating to a drilling condition for the hybrid drill bit; and simulating drilling of an earth formation by the hybrid drill bit based on the plurality of parameters and the additional plurality of parameters.

* * * * *